United States Patent [19]

Vogt

[11] Patent Number: 4,635,965

[45] Date of Patent: Jan. 13, 1987

[54] INFORMATION CARRIER IN THE FORM OF A CARD

[75] Inventor: Werner Vogt, Schlieren, Switzerland

[73] Assignee: Interlock Sicherheitssysteme, Schlieren, Switzerland

[21] Appl. No.: 773,851

[22] Filed: Sep. 9, 1985

Related U.S. Application Data

[60] Continuation of Ser. No. 613,841, May 24, 1984, abandoned, which is a division of Ser. No. 399,949, Jul. 20, 1982, Pat. No. 4,464,454.

[30] Foreign Application Priority Data

Jul. 20, 1981 [CH] Switzerland ..... 4753/81

[51] Int. Cl.[4] ..... B42D 15/00

[52] U.S. Cl. ..... 283/112; 283/904; 283/77; 430/10; 430/256

[58] Field of Search ..... 283/74, 75, 76, 77, 283/106, 107, 108, 109, 110, 111, 112, 904; 430/10, 256, 263, 961

[56] References Cited

U.S. PATENT DOCUMENTS

| | | | |
|---|---|---|---|
| 3,520,682 | 7/1970 | Gross | 430/256 X |
| 3,758,970 | 9/1973 | Annenberg | 430/10 X |
| 3,871,119 | 3/1975 | Mayer | 283/77 X |
| 4,101,701 | 7/1978 | Gordon | 430/10 X |
| 4,389,472 | 6/1983 | Neuhaus et al. | 430/10 |
| 4,389,480 | 6/1983 | Franke et al. | 430/256 X |

FOREIGN PATENT DOCUMENTS 2435357 4/1980 France .

*Primary Examiner*—Paul A. Bell
*Attorney, Agent, or Firm*—Edwin E. Greigg

[57] ABSTRACT

A method for producing an information carrier in the form of a card, such as an identification card or pass, as well as an information carrier produced in accordance with this method. The information carrier comprises a plurality of plastic layers combined with one another into a block, at least one of which contains a photograph of the bearer and/or his fingerprint and/or other readable or machine-readable data in the form of a photographic layer. This photographic layer is produced and incorporated into the sandwich of plastic layers making up the identification card in that a specially prepared film is exposed to light, developed, fixed and dries, and then the carrier layer of this film sandwich is removed from the emulsion after the emulsion has entered into an adhesive bond with a first plastic carrier layer, this adhesion being substantially greater than the adhesion of the emulsion to the film's auxiliary carrier, which is to be removed.

12 Claims, 5 Drawing Figures

Fig. 1
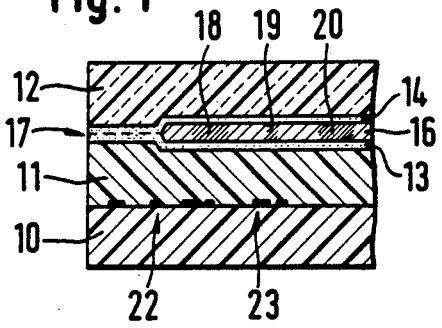
Fig. 2
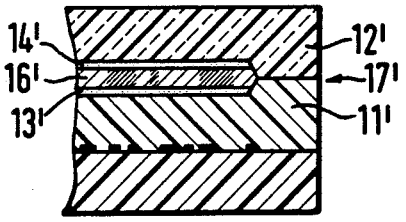
Fig. 3
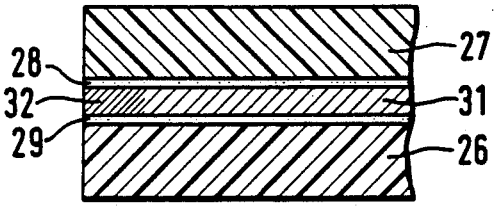
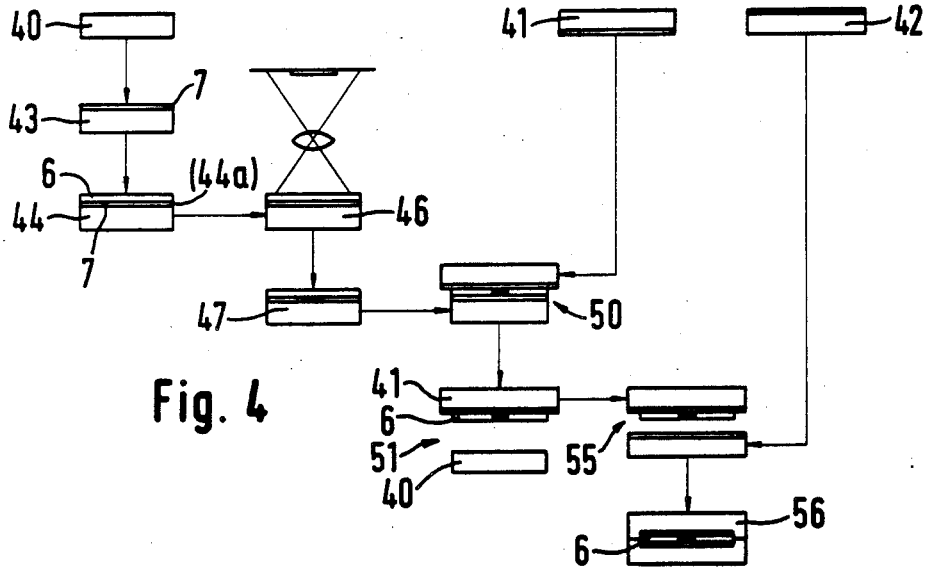
Fig. 4
Fig. 5
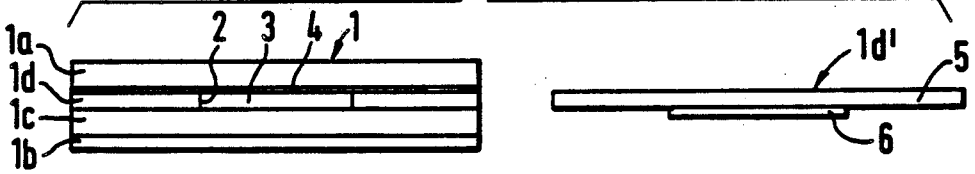

INFORMATION CARRIER IN THE FORM OF A CARD

This application is a continuation of application Ser. No. 613,841 filed May 24, 1984, now abandoned which is a division of Ser. No. 399,949 filed July 20, 1982, now U.S. Pat. No. 4,464,454.

BACKGROUND OF THE INVENTION

The invention is directed to an information carrier in the form of a card. An identification card is known from French Pat. No. 2,435,357, in which a light-sensitive layer or photo layer is applied to a carrier layer of polyvinylchloride (PVC). This photo layer itself is in turn made up of a sequential layering of a first polyester layer, a removable layer adjacent thereto, the actual light-sensitive layer, which has a thickness merely of a few $\mu$ and therefore corresponds to the photoemulsion, an adhesive layer adjacent thereto, and a lower protective layer, for instance, paper which has been treated in a specific manner. In this known device, it is of substantial significance that the emulsion layer is not exposed to light and its sensitivity is adjusted such that exposure to light is effected only with a particularly strong and intense light source, while normal ambient light is of little influence.

In producing this card, the procedure then is such that first the lower protective layer is removed, and the remaining coating having the film emulsion is pressed onto the PVC carrier layer, to which it adheres because of the adhesive layer already mentioned. The first polyester layer is then removed, which is facilitated by the removable intermediate layer located between the actual emulsion and this first polyester layer, and the card thus far prepared and having the film emulsion, which has not yet been exposed but is now uncovered, then travels from a magazine to an exposure station where exposure is performed under the influence of strong ultraviolet radiation. A number of developing, brushing, rinsing and drying steps then follow, during which a given card is transported, with the aid of reversible slides, into the individual baths and treatment stations. At a final station, a polyester protective layer is then applied by heat-pressing to the emulsion layer, which was until then still uncovered, although already developed. Nevertheless, it is not possible to preclude difficulties with an information card of this kind, which may arise either at that time or upon later use and are caused by insufficiently firm bonding of the polyester layer last applied with the remaining material making up the card, because as is well known, polyester cannot be made to adhere with sufficient fastness when it is heat-pressed.

A further problem is presented by the preparation of the card, in the course of which first two layers have to be removed from the photo layer encompassing the emulsion layer, and then this layer has to be glued in an intermediate step to the PVC carrier layer, all this being done while the emulsion is still unexposed and thus vulnerable. Furthermore, it cannot be precluded that the total effort of exposing and developing the emulsion which must be undergone during the process of producing the card may be in vain (since the identification card is not complete and the emulsion layer is not covered until the final polyester layer has been applied) because of damage to the just-exposed emulsion layer or the possible separation of this layer either partially or in its entirety in the various baths and brushing and drying stations. The total effort involved in producing an identification card of this kind is considerable. It may also be presumed with this known identification card that a colored version of the image cannot be obtained by ultraviolet exposure, being the development of a color photograph necessitates a substantially greater number of baths and intermediate steps than can be withstood, in terms of the stability and adhesion of the emulsion, given a method of this kind which involves belated exposure and development. Furthermore, it is not possible to obtain a color composition of the image that is pleasing to the normal eye by using an exclusively ultraviolet exposure method.

In summary, this known identification card is produced in the following manner. The starting material is an unfinished card, which on the obverse and reverse already has impressions (that is, data and writing) on its PVC card carrier. The reverse already has a plastic coating, specifically a plastic lamination, and on the obverse there is an area on which there is no information, to which the photo emulsion is then glued in the manner described above. After exposure to light and development, the obverse is then laminated as well by heat-pressing the polyester protective layer onto it. The manner in which the photo emulsion is glued to the PVC carrier is not described in this French patent; apparently the removal of the upper and lower protective or carrier layers, which together with the photo emulsion and further adhesive layers make up the light-sensitive coating, is a manual procedure. A further disadvantage of this known method of production is, finally, the fact that the belated exposure of the photo emulsion, in other words after the photo emulsion has been glued onto the PVC carrier, can be accomplished only poorly and with a sacrifice of quality, if for no other reason then because under practical conditions it is impossible to apply the adhesive layer, which is always required, so absolutely uniformly that distortions in making the image can reliably be avoided.

It is furthermore generally known, in producing an identification card carrying a photographic image of the user or bearer, to stamp an intermediate foil or coating to cut out a space of the same size and shape as the photograph to be inserted there, and then to place a finished photograph in the stamped-out area. Then further coatings and foils are disposed on either side of the card, and these plastic layers are sandwiched together via adhesives and/or the effects of pressure and heat. In so doing, an additional adhesive has to be applied at least where the photograph (which itself is a sandwich comprising the carrier and the emulsion) is located, for the sake of the plastic layer which is to cover it, so that sufficient adhesion is assured at this location; otherwise, merely bending the identification card once or twice might cause separations and bubbles just at the place where the photograph of the bearer and/or other data are located.

With all types of passes or identification cards including or receiving an image or in any event a photographic layer, it is accordingly problematical that such images can be obtained only on a base of a type of material which cannot be bonded to the material making up these passes. Normally conventional photographs on paper are used, for instance Polaroid photographs, and no actual contact exists between the surface of the photograph and the plastic layers covering it. Even if an adhesive is applied, then it is only the photographic emulsion of the paper image which adheres to the adhesive, and if the identification card were arbitrarily opened—which is not precluded if there is an intent to counterfiet—the photographic emulsion would tear away. This accessibility involves security aspects which cannot be left unaddressed. Furthermore, the known provisions generally result in sacrifices in terms of the quality of such identification cards, because these cards are made of various materials. A prime example of the production of identification cards of this kind is offered by U.S. Pat. No. 4,101,701, for example, in which suitable glues and adhesives are also disclosed, so as to be able to effect the combination of the individual plastic layers with the Polaroid photograph placed among them.

Because of the known prior art, the problem accordingly exists of how an image—for instance, the representation of the bearer's face—can be attained in an identification card without this image acting as a foreign body in the card, without providing opportunities for counterfeiting and preferably without having the image in the identification card completely cover the area which it occupies, that is, without the image covering the area such that light cannot reach it.

As a matter of fact, because the image in the pass does have the character of a foreign body, as is also perceptible tactilely from the thickening at that location on the pass, there is the further danger that at such locations the pass or identification card will break—that is, in the vicinity of the edges; the danger of counterfeiting in a card of that kind also exists, because the inserted photograph can simply be cut out and replaced with another.

Identification cards may be embodied as personal passes, for instance enabling a particular person to attain access to an area not open to the public, or else they may be embodied as impersonal passes, for instance authorizing the bearer at a given time to obtain goods or services. The card and the means used to identify the bearer may be quite various, and they generally depend on the intended use for the card. Transferrable customer cards of department stores or credit organizations are made simply of a single plastic layer, on which the name of the issuer is printed and on which both the name and an individual identification number are stamped. In contrast, personal passes comprise a plastic laminate having a layer on which data visible to the human eye are entered in uncoded form, and which may also have a window for the emplacement of a photograph, as already mentioned. It is also possible for machine-readable data to be provided which are invisible to the human eye, or in any event are encoded such as not be comprehensible visually, perhaps disposed on a further layer, the data being readable by infrared radiation, for instance.

It is clear that producing an identification card is all the more difficult, the more data are disposed on the card. This is particularly true for the layer carrying the data which are visible to the human eye and entered in uncoded form, which generally encompass the name of the issuer, the designation of the area in which the card is valid, one or more identification numbers, the name and perhaps the address of the bearer as well as a photograph of the bearer. Only generalized information which is the same for many cards—for instance, the name of the issuer or the area of validity—can usually be placed on the card by machine, while the data pertaining to the bearer require a number of different manual operations which must be performed separately.

It is accordingly an object of the present invention to provide identification cards the production of which has been substantially simplified, assuring high quality of the final product (preferably including a color image), and provides a final product, namely the identification card, which is also sufficiently counterfeit-proof.

ADVANTAGES OF THE INVENTION

This object is attained according to the invention which has the advantage over the known identification cards that the layer or section of a layer which carries the preferably color image and/or a fingerprint of the bearer and/or other information visible and interpretable by the human eye is not a foreign body in the identification card but rather is a natural component thereof, without changing the thickness of the card in the part thereof where it is located. The image, the inscription means and/or the fingerprint are fundamentally contained in a transparent form in the identification card, thus attaining the further advantage that the image or other data are not disruptive in the event of a possible supplementary infrared evaluation of the card by some suitable appliance which detects machine-readable encoded material; in other words, the transparency of the color image of the bearer's face, of his fingerprint or of the data which are visible to and readable by the human eye means that no hindrance is presented to a possible evaluation of information located underneath these data. The dyes which are used, preferably organic dyes, are not opaque.

In every case, the image or data area, as it is realized merely by disposing the emulsion of the photographic layer within the identification card, does not form any perceptible borders or edges; this area is absolutely inseparably contained within the identification card and represents an integral part thereof.

It is furthermore particularly advantageous that the identification card can be manufactured on the basis of layers of polyvinylchloride (PVC); the result accordingly obtained is a smooth and pleasing appearance of the identification card, and it is assured that the card represents an entirely inseparable and thus integral whole, including the image, the fingerprint and/or other data, because by avoiding the use of other materials, for instance polyethylene layers, it is possible to obtain absolutely satisfactory union, even on the molecular scale, solely by the effects of heat and pressure.

It is advantageous that only a single operation is required to incorporate all the visible data, among them the (color) picture, the possible disposition of the bearer's fingerprint and other data to be read, within the layer provided for them. Production is thus simplified substantially; it becomes more favorable in cost, and the chance of error in entering the various data is reduced. Even if the layer containing such visible data (photograph, fingerprint, other data) extends over the entire area of the card, it is still possible for the card to include further data, for instance data which are not visible to the human eye but are readable with infrared radiation and thus machine-readable, and which again may extend over the entire area of the identification card. Thus in the final analysis, the area available for the reception of information of any desired type is practically twice as large as the area of the identification card itself. The reason for this is the transparency, discussed above, of the layer which contains the visible data, because this layer is made up solely of the emulsion itself.

DRAWING

Exemplary embodiments of the invention are illustrated in the drawing and will be described in greater detail below.

FIGS. 1, 2 and 3, in a partial cross sectional representation, show possible exemplary embodiments of an identification card produced according to the invention having a photographic emulsion located inside it;

FIG. 4 is a flow diagram for the preferred form of embodiment of a method for producing the identification card; and FIG. 5, in cross section, shows the basic structure of an identification card having a middle layer, which by its replacement by the definition according to the invention permits an understanding of the basic concept of the present invention, and which serves to provide better comprehension of the present invention.

DESCRIPTION OF THE EXEMPLARY EMBODIMENTS

The basic concept of the present invention is the removal, out of a sandwiched or bonded combination of an auxiliary carrier and a single photographic emulsion whose thickness amounts to only a few $\mu$, approximately $1.5\mu$, of the completely exposed, developed, fixed and dried state, and then the transfer of the emulsion, without the auxiliary carrier layer, first onto a carrier layer which is already a component of the later identification card; this union between the emulsion and this carrier layer is realized by means of an effective adhesive layer.

In order to comprehend the present invention, the point of departure is the cross sectional view shown in FIG. 5, which in this form is capable of illustrating the known layering of an identification card. The identification card in FIG. 5 is indicated by reference numeral 1. It has a first covering layer 1*a;* a back layer or back foil 1*b;* a foil 1*c*, called the code layer, adjoining the top of the back foil 1*b;* and a layer 1*d*, underneath the covering layer 1*a*, which contains the visible image and may also include other visible information, which by way of example is printed thereon. This printing- and image-containing layer 1*d* has heretofore been produced in such a manner that a stamped-out area 2 is provided in this layer 1*d*, and a photograph is then placed into this open space, for instance a Polaroid photograph 3 on paper, this having a suitable adhesive layer at least at 4 which is oriented toward the covering layer 1*a*, so that the surface of the photograph is bound to the covering layer 1*a;* otherwise, separations, bubbles and other problems would surely arise. To this extent, what is shown in FIG. 5 corresponds to the prior art discussed earlier.

Now in accordance with the primary proposition of the invention, this layer 1*d* is replaced with a layer 1*d'*, as is shown on the right-hand side of FIG. 5 in the plane of the drawing. This layer 1*d'* is embodied by a continuous carrier layer 5, preferably of PVC, and a film emulsion 6 glued firmly thereto which is purely a film emulsion yet has already been fully developed and includes all the data. It should be noted that in the drawings, for the sake of clearer illustration, the relative thickness of the individual layer is not to scale; in particular, the thicknesses of the emulsion layer 6 and of the adhesive or glue layers are shown on a greatly enlarged scale. In fact, the thicknesses of these layers are smaller by orders of magnitude than those of the other layers or foils 1*a*, 1*b* etc. shown in FIG. 5 in order to illustrate the overall embodiment of the identification card.

Accordingly, the following preferred production of such identification cards or passes is arrived at, as shown in FIG. 4. The point of departure is an auxiliary carrier 40, which as shown at 43 has been pretreated in a specific manner on one side. This pretreatment, which imparts a specific texture to the surface or provides a specific coating 7 therefor, may be of various types. In any event, it is performed such that a photographic emulsion or photographic layer which is later applied to the auxiliary carrier 40 adheres so firmly—but only just that firmly—to the auxiliary carrier 40 that the sandwich or bond comprising the auxiliary carrier 40 and the photographic emulsion 6 is capable of withstanding the steps of exposure to light, development, fixing and drying without either any loss in quality or mechanical disassembly. The coating 7 may be an adhesive layer, which has only slight adhesive strength or tensile strength; however, it is also possible for the auxiliary carrier merely to be textured, for instance provided with a very specific surface roughness, perhaps with the aid of a corona discharge.

As shown at 46, the "film" thus produced, comprising the auxiliary carrier 40 and the emulsion 6, is then subjected to photographic exposure. In this exposure step, it is possible for all the desired data to be applied to the emulsion in the form in which they will later be found on the information card itself, for instance such that they are visually recognizable to the human eye or are accessible to interpretation by machine. Specifically, it is possible for a picture of the bearer's face, preferably in color, to be applied to the emuslion; the present invention, because of its basic concept, is entirely capable of achieving this, and the invention is furthermore fundamentally distinguished over the prior art by this feature and the advantages it offers. It is furthermore possible, by means of the photographic exposure of the film comprising the auxiliary carrier 40 and the emulsion 6, for one or more fingerprints of the authorized bearer of the card to be represented, either in visible form or in any case in such a form that machine-readable data relating to the unique fingerprint are produced on the information card. At this point, it is then also possible to accommodate all the other desired data on the emulsion, which thus far represents an information carrier for preferably visible data.

Following the exposure step at 46, the "film" is developed, fixed and dried, which is indicated in general at 47. At that time, the auxiliary carrier 40 then has a preferably colored, positive image of the photograph of the card bearer and all other desired data, in high-quality and satisfactory form, such as is customary with conventional films as well.

The development, fixing and drying step at 47 can be followed by a stamping-out or cutting operation, which is not shown in FIG. 4 but which serves to cut the film material of the information carrier to the desired size and shape.

Next, as shown in FIG. 4 at 50, a prepared carrier layer or carrier foil 41 is coated, preferably on the side oriented toward the accessible emulsion 6 of the "film", with a suitable gluing or adhesive means, then guided alongside the emulsion and placed thereon approximately as shown at 50, and the laminate structure or sandwich including the film comprising the auxiliary carrier 40 and the emulsion 6 is then bonded together.

This may be effected by the action of pressure and/or heat, for instance.

At this time, all the layers are at first larger than the desired final card format. A later stamping or cutting step then produces the intended size and shape of the sandwich. It is thereby assured that during pressing and heating, any peripheral areas which are not absolutely satisfactory will be eliminated in the stamping process.

The adhesive layer may be present on the carrier layer from the outset; or alternatively, it is also possible, and should be mentioned at this point as a further embodiment of the present invention, for the "film", during the course of the development and fixing steps, to be placed in a solution, comprising its final bath, which directly contains a suitable glue, so that the emulsion when removed from this bath is saturated with this carrier. Then all that remains to be done is to place the (PVC) carrier layer onto the free side of the emulsion of the "film" and to bond the sandwich together. The same process—that is, bonding the emulsion without a separate application of glue—is attained when a second plastic layer is applied to the other or back side of the emulsion, which when the auxiliary carrier is removed also becomes a free side, because in the bath the emulsion will have absorbed the glue in spongelike fashion. As will be understood, the application of one layer to another is effected with the aid of a positioning system; the glue combining the carrier layer 41 and the emulsion 6 has two functions, that is, first to furnish the intimate union with the plastic of the carrier layer (PVC), perhaps under the influence of heat and pressure, and second to assure such firm adhesion between these two layers 41 and 6 that subsequently, as shown at 51 in FIG. 4, the auxiliary carrier can be removed from the emulsion layer 6, which now firmly adheres to the carrier layer 41 and is in a completely developed state, provided with all the data. The primary property of the auxiliary carrier 40, however, is that its association with the emulsion 6 is such that once the emulsion has been provided with the necessary data and has been conditioned, the auxiliary carrier 40 is loosened from the emulsion 6 without any damage being caused. The provisions required to accomplish this are technologically attainable without notable effort; in the method according to the invention, the essential factor in this respect is that the tensile strength of the adhesion, or of the adhesive layer between the carrier layer 41 and the emulsion 6, is greater—in fact, preferably several times greater—than the tensile strength of the adhesion or bonding existing between the emulsion 5 and the auxiliary carrier 40. The tensile strength of this last bond must furthermore also be less—in fact, much less—than the tearing strength of the emulsion itself. It is within the competence of one skilled in the art to select from among the many materials available on the market to find such materials as are required in order to release the method described thus far and to produce an indentification card as described and with given properties, so that in principle the recitation of particular suitable materials will be dispensed with here. However, it is noted that foils of polyvinylchloride are preferably used for the layers which will later make up the identification card; these foils have particularly advantageous properties and are preferred over polyester because, among other reasons, polyester itself is not capable of combining with plastics in such a manner that it will not loosen. Basically polyester does permit separation, so that loosening of the bond between individual layers cannot be precluded. Nevertheless, the usage of polyester naturally is within the scope of the method according to the invention.

The bonded combination of a carrier layer 41 and emulsion 6 shown at 51 in the flow diagram of FIG. 4 otherwise corresponds to the intermediate layer 5 as shown in FIG. 5; from the outset, it is already part of the identification card which now remains to be finished. The next step, as shown at 55 in FIG. 4, is that after the auxiliary carrier 40 is removed from the emulsion, a further prepared plastic layer 42 is applied to the other side of the emulsion. Depending upon whether the layers 41, 42 are covering layers or base layers, they may be embodied as transparent or opaque; it is also possible for both of them to be either transparent or opaque, depending upon the intended use and upon whether there is a requirement for machine-readability or for the recognition of data by the human eye. In order that they may be combined both with the emulsion 6 located between them and with each other as well, the layers 41 and 42 are provided with adhesive layers such as is indicated in FIG. 4; these layers may be heat-sealing paints, as a result of which effective union is attained by heating and exerting pressure, and it is also assured that the emulsion 6 is enclosed within the two top and bottom layers 41, 42 in such a way as to preclude any vulnerability to dampness.

If adhesive layers are provided, then preferably they extend over only that area which is occupied by the emulsion. In other words, if the emulsion is smaller in area than the other plastic layers, then it is assured that in the peripheral areas nothing but plastic comes to rest against plastic, or PVC on PVC, which can be well bonded to one another.

The structure indicated at 56 in FIG. 4 can then be augmented as desired by means of still further steps, as shown in FIG. 5; but these do not need to be addressed here.

Depending upon the type of material used for the carrier layers oriented toward the emulsion, plastic bonding is also a possibility, which may selectively involve heat sealing. A particularly suitable adhesive or glue layer can be obtained by the use of a glue sold under the trade name Acronal 300 D; Acronal is an aqueous dispersion, free of softening agents, of a terpolymer comprising an acrylic acid ester vinyl acetate and vinyl chloride.

It is not of critical importance which material is used for the auxiliary carrier in performing the described method. Proven materials are the polyester conventionally used as a carrier for photographic films, or simply polyvinylchloride. The term "plastic" used for the carrier layer and the covering layer encompasses all polymeric, thermoplastic materials, although as already mentioned the polyvinylchloride conventionally used for producing identification cards is preferably used here. Under particular circumstances, it may be that suitable materials for an adhesive layer also disposed on the auxiliary carrier in the event that it remains within the sandwich or bond would preferably be heat-sealing paints, the sealing temperature of which is below the bonding temperature of the polymeric, thermoplastic material or below the sealing temperature of the adhesive layer located on the carrier layer and the covering layer. Materials suitable for the carrier and covering layers and having adhesive layers applied to one side thereof are also available on the market.

It will be understood that in realizing the described card it is preferably not individual, precut pieces but rather long strips which are used for both the auxiliary carrier and the carrier and covering layers. It is furthermore possible, in stacking up the carrier layer combined with the photographic layer and placing the covering layer on the carrier layer, to stack up further layers as well, if a multi-layered identification card of the type still to be described below in connection with FIGS. 1 and 2 is to be produced. These steps are again known to anyone skilled in the art, so that they need not be described in detail here. Finally, it will be understood that the steps 50, 55 may be performed in reverse order; that is, a transparent covering layer can be combined with the emulsion first, and an opaque carrier layer can be combined with it thereafter. In so doing, care should be taken that the transparent covering layer be disposed such that the data in the photographic layer can be read from the correct side.

The dimensions of conventional identification cards are specified in DIN 9 781. It should be noted merely that the thickness of a proven color-photographic layer amounts to approximately 20 μm; the thickness of each of the adhesive layers on the carrier and covering layers is approximately 2 to 5 μm, which in a card with a directly sealed peripheral area (FIG. 2) corresponds to a multi-layered inclusion having a total thickness of 24 to 30 μm. This thickness of this inclusion is partially compensated for, when the peripheral area is bonded, by the material of the carrier and covering layers which begins to flow during this process, and in every instance this thickness is within the permissible tolerance for the thickness according to the above-mentioned published specifications, which is ±80 μm.

In the following description, preferred forms of embodiment of identification cards will be explained with reference to FIGS. 1, 2 and 3. The form of embodiment of the new card shown in FIG. 1 in a partial section includes a base layer 10, a carrier layer 11 and a covering layer 12. The base and carrier layers are opaque to visible light but are transparent to infrared radiation. The covering layer is transparent to visible light. The carrier layer and the covering layer have respective adhesive layers 13 and 14 on their respective surfaces oriented toward one another. The photographic emulsion 16 is disposed between the carrier layer and the covering layer. The emulsion is substantially thinner than the carrier layer and the covering layer, so that the latter two layers are in contact with one another via their adhesive layers in the vicinity of the peripheral edge 17 and enclose the emulsion. The emulsion includes areas 18, 19, 20, representing data written clearly and recognizable through the transparent covering layer. Between the base layer and covering layer, which are both transparent only to infrared rays, as already mentioned, there are further markings 22, 23 which are opaque to infrared radiation and which represent encoded, machine-readable data.

The further form of embodiment shown in partial section in FIG. 2 has virtually the same structure as that of FIG. 1, so that a description of the individual layers will not be repeated here. The difference between the two forms of embodiment is that the adhesive layers 13', 14' do not extend outward beyond the peripheral area of the emulsion 16', so that the carrier and covering layers 11' and 12' are in direct contact with one another in the vicinity of the peripheral edges 17'.

FIG. 3 is a schematic partial section taken through a further form of embodiment. This embodiment includes a carrier layer 26, which is opaque to visible light, and a covering layer 27, which is also opaque to visible light. The carrier and covering layers are provided on their surfaces oriented toward one another with respective adhesive layers 28 and 29, and the emulsion 31 is disposed between those two layers. The emulsion has a continuous edge 32 in the vicinity of the edges of the card, within which edge 32 the layer is water-repellent, by means of a suitable subsequent treatment, or at least is not swellable.

In all three forms of embodiment, the emulsion is durably bonded, with the aid of the adhesive layers, to the adjacent carrier and covering layers. As a result of the framing of the photographic layer in the peripheral area of the card as in the forms of embodiment shown in FIGS. 1 and 2 or as a result of the subsequent treatment of the layer as in the form of embodiment shown in FIG. 3, it is attained that despite the generally hydrophilic emulsion of the photographic layer, the identification card will not swell or otherwise be damaged even under relatively longterm exposure to water or dampness.

It will be seen that the card according to the invention is particularly advantageously suited to the rendition of color pictures in an identification card realized in a transparent and absolutely counterfeit-proof manner.

It will be understood that the machine-readable data between the two layers which are opaque to visible light need not necessarily be markings which are recognizable using infrared light, but that electrically or magnetically readable markings may be used instead.

A further advantageous embodiment within the scope of the invention, while maintaining the advantages and the basic principles of the auxiliary-carrier concept, is the use of a "film" in step 44 which may be said to have two auxiliary carriers, that is, the normal auxiliary carrier 40, the reference numeral of which will accordingly remain the same, and a second auxiliary carrier, which may then be designated as a so-called "accessory auxiliary carrier" and is a particularly thin layer or foil, the thickness of which is preferably on the order of magnitude of that of the emulsion 6 and which may be located between the auxiliary carrier 40 and the emulsion, as indicated in FIG. 4 at 44*a;* alternatively, the "accessory auxiliary carrier" could be disposed on the free top surface of the emulsion, but this would be less likely. A preferred, detailed exemplary embodiment is then realized in that by way of example, a normal polyester foil can be provided as the auxiliary carrier 40, to which a further, extremely thin polyester film adheres, in fact with an adhesive capacity such as that described above with respect to the adhesion or bond existing between the auxiliary carrier 40 and the emulsion 6. The actual emulsion 6 is then poured onto this extremely thin intermediate foil or accessory auxiliary carrier, to which it then adheres with a conventional and even quite strong adhesive force. This may be accomplished in a conventional manner with the aid of a glue; however, preferably it is attained in that the extremely thin accessory auxiliary carrier layer has an appropriate texture and forms a substrate in such a manner that the accessory auxiliary carrier is entirely inseparable from the emulsion.

Further processing is then effected as described earlier; after the steps of exposure, development, fixing and drying, the auxiliary carrier 44 is removed, in this case with the aid of the accessory auxiliary carrier 44*a*, which therefore remains bonded to the emulsion and, because it is itself also extremely thin, it contributes just as little to the overall thickness of the identification card in the course of further processing as would have been the case using the emulsion layer alone.

By the disposition of an accessory auxiliary carrier in this manner, preferably in the form of a super-thin polyethylene foil, the production method may be made easier, for instance if the method additionally or exclusively involves the application of fingerprint photographs to the identification card. For instance, with continuous production, the individual photographs of fingerprints can be copied by photographic exposure on a roll of film, comprising as noted above the auxiliary carrier, the accessory auxiliary carrier and the emulsion, and can then be developed, fixed and dried. This is represented by step 47 of FIG. 4, although in that case the step involves roll film with a multiplicity of fingerprints, possibly together with images, other data and information and the like. For further processing, the procedure is then such that the individual images removed from the roll in a continuous strip are incised, by means of a cut which is extremely precisely dimensioned in height, down to a thickness which reaches from the surface through the emulsion and the accessory auxiliary layer, at least as far down as the actual auxiliary carrier layer itself and preferably on into this layer as well. The carrier layer 41 is then glued from above onto the emulsion in the manner already described, and the auxiliary carrier 40 can be removed, this action being facilitated by the incision that has been made.

In terms of the properties of the material making it up, the auxiliary carrier 40 may also be made of a suitable paper. The polyethylene foil already mentioned is preferably used as the accessory auxiliary carrier in the extremely thin realization, because of course this foil then remains against the emulsion while the structure of the indentification card is being built up.

What is claimed and desired to be secured by Letters Patent of the United States is:

1. An information carrier in the form of an identification card, consisting of a multiplicity of plastic layers bonded together in a block, which comprises at least a first covering plastic layer, an adhesive layer on one side of said at least first covering plastic layer, a developed photographic emulsion including multiple types of visible information data secured by a first side onto said one side of said at least first plastic layer by said adhesive, a second carrier plastic layer applied onto a second side of said developed photographic emulsion, all of said layers are bonded together to form said identification card, whereby said emulsion extends to the outer edges of said identification card between said carrier and covering layers having a continuous edge in the vicinity of the edges of the card, said continuous edges being of water repellent quality.

2. An information carrier according to claim 1, which includes an accessory auxiliary carrier foil having approximately the same thickness as said photographic emulsion attached to one side of said photographic emulsion only between said photographic emulsion and one side of said first or second plastic layers, said accessory auxiliary carrier foil resulting from developing stages of the photographic emulsion.

3. An information carrier in the form of an identification card, consisting of a multiplicity of plastic layers bonded together in a block, which comprises at least a first covering plastic layer, an adhesive layer on one side of said first covering plastic layer, a developed photographic emulsion including multiple types of visible information data secured by a first side onto said one side of said at least first plastic layer by said adhesive, a second carrier plastic layer applied to a second side of said developed photographic emulsion, all of said layers are bonded together to form said identification card, said first and second covering carrier plastic layers are made of polyvinyl-chloride and said first and second plastic layers are directly attached to said developed photographic emulsion by intermediate adhesive layers only.

4. An information carrier according to claim 3, which includes an accessory auxiliary carrier foil having approximately the same thickness as said photographic emulsion attached to one side of said photographic emulsion only between said photographic emulsion and one side of said first or second plastic layers, said accessory auxiliary carrier foil resulting from developing stages of the photographic emulsion.

5. An information carrier in the form of an identification card consisting of a multiplicity of plastic layers bonded together in a block, which comprises at least a first covering plastic layer, an adhesive layer on one side of said at least first covering plastic layer, a developed photographic emulsion including multiple types of visible information data secured by a first side onto said one side of said at least first plastic layer by said adhesive, a second carrier plastic layer applied to a second side of said developed photographic emulsion, all of said layers being bonded together to form said identification card, whereby said photographic emulsion is arranged within an enclosure between said at least first covering plastic layer and said second carrier plastic layer and completely surrounded by edges formed by the direct adhesion of said at least first covering plastic layer and said second carrier plastic layer.

6. An information carrier according to claim 5, characterized in that emulsion free edges formed by said at least first covering plastic layer and said second carrier plastic layer are glued together by said adhesive layer.

7. An information carrier according to claim 6, which includes an accessory auxiliary carrier foil having approximately the same thickness as said photographic emulsion attached to one side of said photographic emulsion only between said photographic emulsion and one side of said first or second plastic layers, said accessory auxiliary carrier foil resulting from developing stages of the photographic emulsion.

8. An information carrier according to claim 5, characterized in that emulsion free edges around the enclosed photographic emulsion are formed by direct contact of said at least first covering and said second carrier layers.

9. An information carrier according to claim 8, which includes an accessory auxiliary carrier foil having approximately the same thickness as said photographic emulsion attached to one side of said photographic emulsion only between said photographic emulsion and one side of said first or second plastic layers, said accessory auxiliary carrier foil resulting from developing stages of the photographic emulsion.

10. The information carrier according to claim 8, wherein said first and second plastic layers are bonded together with their emulsion free edges by the action of heat and pressure.

11. An information carrier according to claim 5, which includes an accessory auxiliary carrier foil having approximately the same thickness as said photographic emulsion attached to one side of said photographic emulsion only between said photographic emulsion and one side of said first or second plastic layers, said accessory auxiliary carrier foil resulting from developing stages of the photographic emulsion.

12. The information carrier according to claim 11, wherein said accessory auxiliary carrier is a polyethylene foil attached to said photographic emulsion by a slight adhesive intermediate layer.

* * * * *